United States Patent [19]

Sickmeier

[11] 3,989,537

[45] Nov. 2, 1976

[54] METHOD AND APPARATUS FOR VIBRATION CLEANING OF WORKPIECES SUCH AS ENGINE BLOCKS

[75] Inventor: Edgar W. Sickmeier, Greenwood, Ind.

[73] Assignee: General Motors Corporation, Detroit, Mich.

[22] Filed: July 11, 1975

[21] Appl. No.: 595,041

[52] U.S. Cl. ..... 134/1; 134/23; 134/33; 259/1 R

[51] Int. Cl.[2] ..... B08B 7/02

[58] Field of Search ..... 134/1, 23, 32, 33, 161; 259/1 R, 75, 81 R

[56] References Cited

UNITED STATES PATENTS

| | | | |
|---|---|---|---|
| 2,824,029 | 2/1958 | Zinty | 134/23 |
| 3,162,910 | 12/1964 | Behnke et al. | 259/1 R X |
| 3,419,429 | 12/1968 | Zadron et al. | 134/33 |

*Primary Examiner*—S. Leon Bashore
*Assistant Examiner*—Richard V. Fisher
*Attorney, Agent, or Firm*—Robert J. Outland

[57] ABSTRACT

A method and means are disclosed for vibration cleaning of casting and manufacturing debris from engine blocks and similar articles. The method involves resonant torsional vibration of the workpiece around a longitudinal axis, preferably in the first torsional vibration mode. The workpiece may also be rotated at the same time to permit loosened debris to fall from the walls and cavities. A vibration cleaning stand is also disclosed including a rotatable frame with resilient supports, for holding and rotating an engine block, together with a small eccentric shaker, which is secured to the main bearing caps at one end of the block and rotated by a motor to resonantly vibrate the block in its first torsional mode of vibration.

3 Claims, 7 Drawing Figures

METHOD AND APPARATUS FOR VIBRATION CLEANING OF WORKPIECES SUCH AS ENGINE BLOCKS

FIELD OF THE INVENTION

The present invention relates to vibration cleaning of manufactured articles and more particularly to methods and means for cleaning casting and manufacturing debris from internal combustion engine cylinder blocks and similar articles by resonant torsional vibration around a longitudinal axis.

BACKGROUND OF THE INVENTION

In the manufacturing of heavy articles, particularly cast articles such as engine cylinder blocks, cylinder heads, housings and other such articles, it is a particular problem of the mamufacturing process to remove from such articles various types of debris which are formed or collect therein during the manufacturing process and which may, if not removed, be detrimental to the operation or life of the assembly in which the machined article or component is ultimately incorporated. For example, casting and machining of engine blocks result in a relatively large amount of debris, including core sand, surface scale, machining chips and the like which adhere to the walls and collect in the various cavities and pockets within the engine block, with the result that they are sometimes quite difficult to remove in the manufacturing process. Particles of such debris may, however, if not removed during manufacturing, become loosened in service with the passage of coolant, lubricants and so forth through the engine, in which case such particles may interfere with proper operation of the engine or shorten its life.

In the past, it has been known especially in the case of the engine block castings in the weight range of from about 1,000 to 2,000 lbs. to rely upon a combination of mechanical cleaning and washing steps to remove debris from the machined block castings. It is also known in the art to clean castings and other articles by vibrating them on a shaking table or similar device in order to loosen and remove particles from the interior cavities thereof. However, in many cases such procedures have failed to completely remove debris from internal cavities of engine cylinder blocks and the like, particularly where such debris becomes packed into blind holes or recesses where it cannot be easily reached or dislodged by mechanical or ordinary vibration methods.

SUMMARY OF THE INVENTION

I have discovered a novel method of vibrating articles, particularly heavy articles such as diesel engine cylinder blocks and the like, which is superior to all other methods I have known in removing casting and manufacturing debris from the walls and internal cavities of such articles. The method involves resonant torsional vibration of the workpiece to be cleaned, preferably in the first torsional mode of resonance. This method of vibration is superior to other vibration cleaning methods in several ways. First, it removes greater amounts of debris from both accessible and inaccessible locations within cast and machined articles than do other methods. Second, it accomplishes this result with a lower expenditure of power than conventional vibration methods. Third, the method can be accomplished by application of a relatively small and simple eccentric shaking device to an appropriate location on the cylinder block or other article and by mounting of the workpiece on resilient supports in a roll over stand.

The reasons for the success of my method are believed to be two-fold. First, relatively high accelerations may be obtained during torsional vibration of an article with a limited expenditure of power. For example, it has been calculated that to linearly vibrate a 2,000 lb. engine block with an acceleration of 30 g's would require a shaking force of 60,000 lbs. With my invention, a similar result, wherein a cylinder block of nearly 2,000 lbs. is vibrated in the first torsional mode of resonance with a limiting acceleration of 30 g's, requires a shaking force of only about 300 lbs. placed near one end and displaced from the longitudinal axis of the block, for example, at the bottom thereof. This shaking force may be obtained with an eccentric weight having an unbalance value of only about 0.16 lb.-inches rotatably driven by a 2½ horsepower motor.

It is believed that the high efficiency of my method in removing debris from the interior of cylinder blocks and the like is, in part, due to actual deformation of the cylinder block caused by the resonant torsional vibration method. This form of vibration actually causes the cylinder block to be twisted around its longitudinal axis, causing the debris, packed into closely spaced cavities or adhering to wall surfaces, to be loosened by the physical deflection of the wall and relative movement of adjacent wall surfaces. Obviously, such movement is very small, since it must be limited to an amount which will not excessively deform or damage any portion of the block. It has been learned through testing, that is is possible to select values of resonant vibration which are within the limits of the capabilities of the parts to be cleaned to withstand the strain applied and still obtain highly effective cleaning of debris from the interior walls and cavities.

These and other features and advantages of my invention will be more fully understood from the following description of a preferred embodiment of cleaning means according to the invention and a description of the operational method taken together with the accompanying drawings.

GENERAL DESCRIPTION

Figure 1:
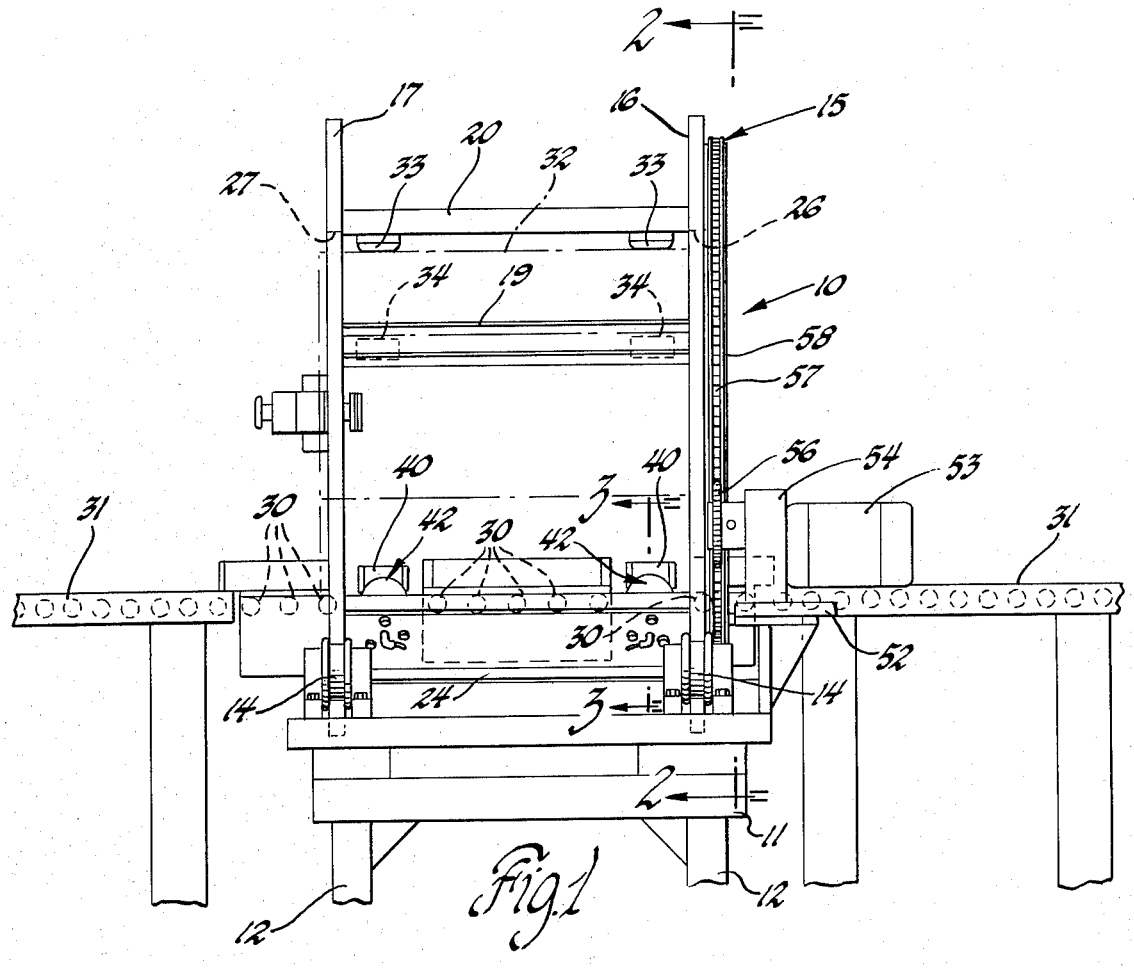
FIG. 1 is a side elevational view of a vibration cleaning stand for engine cylinder blocks formed according to the invention and utilizing the principle of my vibrational method.
Figure 2:
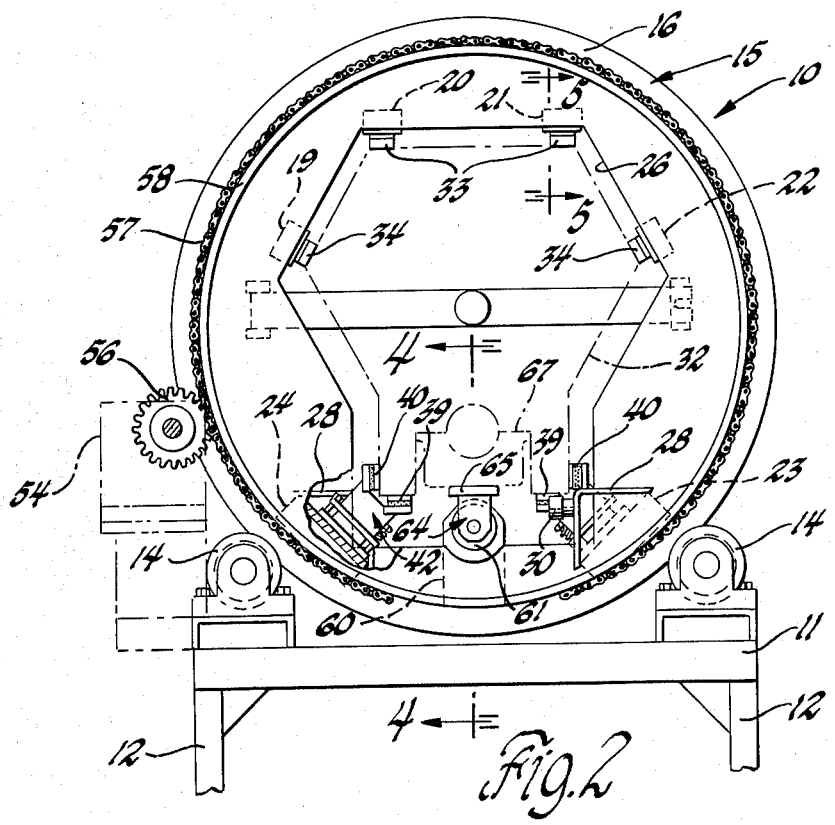
FIG. 2 is an end elevational view of the vibration cleaning stand as viewed from the plane indicated by the line 2—2 of FIG. 1.

FIGS. 1–7 of the drawings illustrate a preferred embodiment of vibration cleaning machine formed in accordance with the invention and generally indicated by numeral 10. Machine 10 is arranged to be utilized for cleaning casting and machining debris from machined cylinder block castings of V-6 and V-8 configuration, weighing between 1,500 and 2,000 lbs.

Cleaning machine 10 includes a rectangular frame structure 11, supported on legs 12 and mounting four rectangularly spaced rollers 14. Supported on the rollers for rotation around a horizontal axis is a drum-like support frame generally indicated by numeral 15.

Support frame 15 includes front and rear circular end plate members 16 and 17, respectively, the outer peripheries of which ride on the rollers 14. The end plates are interconnected by a plurality of longitudinal supports including U section beams 19–24. The end plates are provided with cutout openings 26, 27 to permit the longitudinal passage of an engine block into and out of the machine.

The lower U section beams 23, 24 carry angle members 28 on which are mounted a plurality of rollers 30 that form a conveyor extending beneath the frame rails of the engine cylinder blocks to be cleaned. The internal conveyor formed by rollers 30 cooperates with external roller conveyors 31, mounted at the front and rear of the cleaning machine to provide means for moving the engine blocks into and out of the machine. Obviously, if desired, the operation may be conducted with a single external roller conveyor, by moving the engine block into and out of the machine through the same end of the support frame.

Figure 5:
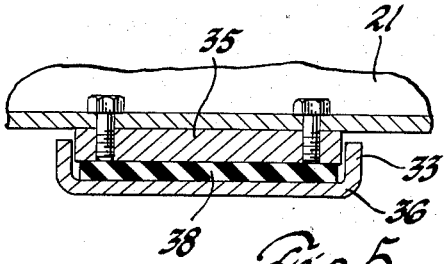
FIG. 5 is a view from the plane indicated by the line 5—5 of FIG. 2 and showing the construction of one of the fixed resilient support pads.

To support an engine block 32 within the cleaning machine, the frame 15 is provided with a group of 16 resilient mounting pads. These include four upper pads 33, supported on the cross beams 20, 21, and four upper side pads 34, supported on cross beams 19 and 22. The construction of these pads, as shown in FIG. 5, includes a base member 35, which is bolted to the beam, and supports a face pad 36, both parts being bonded or otherwise secured to an intermediate resilient rubber block 38. The face portions of the upper pads 33 are adapted to engage the upper surface of the cylinder block, while the face portions of the pads 34 are adapted to engage the outer edges of the right and left bank portions of the block.

Figure 3:
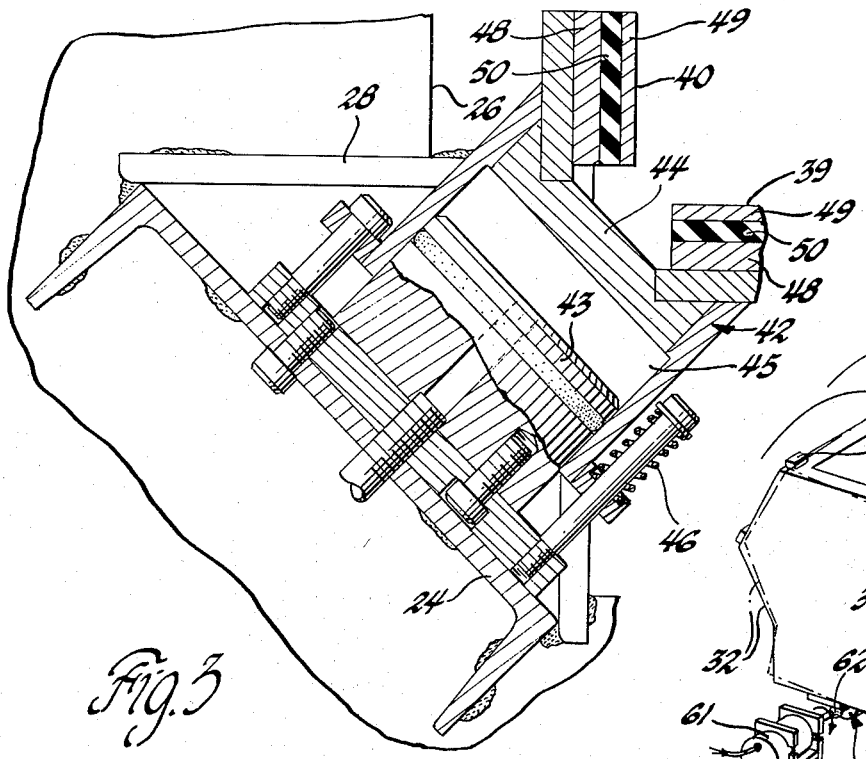
FIG. 3 is a cross-sectional view from the plane indicated by the line 3—3 of FIG. 1 and showing part of the adjustable support mechanism.

Intermediate certain of the conveyor rollers 30 and adjacent the lower frame rails of the cylinder block location there are disposed bottom pads and lower side pads 39, 40, respectively. These pads are supported, as best shown in FIG. 3, on four extensible fluid cylinder assemblies 42 located adjacent the four corner positions of the associated engine block. Each cylinder assembly includes a slidable head 44, supporting one each of the pad members 39, 40, and movable on pistons 43 upon the delivery of pressurized fluid to an internal chamber 45. Springs 46 are provided to retract the cylinder heads when the fluid pressure is relieved.

Like the fixed pads, the movable pads 39, 40 are also formed with base, face pad and rubber block members 48, 49, 50, respectively. Thus, when fluid pressure is applied to the cylinder assemblies 42 and they are extended to the positions shown in FIG. 3, the bottom and lower side pads have been moved inwardly and upwardly into engagement with the side rails of the cylinder block, lifting the block upwardly off the conveyor rollers 30 and into engagement with the fixed upper and upper side pads 33, 34. In this fashion, the block is completely supported with the resilient pads 33, 34, 39, 40 so that it is maintained in position within the support frame 15, but is free, within the limits permitted by the resilient rubber block portions of the pads, to vibrate in a torsional vibration mode around its longitudinal axis, as will be subsequently more fully described. To one side and on the front of the frame 11 there is a drive support 52 which carries an electric drive motor 53 and gear box 54 connecting with a drive sprocket 56. Sprocket 56 engages a chain 57, mounted around a flange 58 on the front end plate 16 of the support frame 15. Operation of the motor rotates the sprocket 56, which drives the chain 57, causing rotation of the support frame 15, thus rotating an engine block mounted therein about a longitudinal axis for purposes to be subsequently explained.

Figure 4:
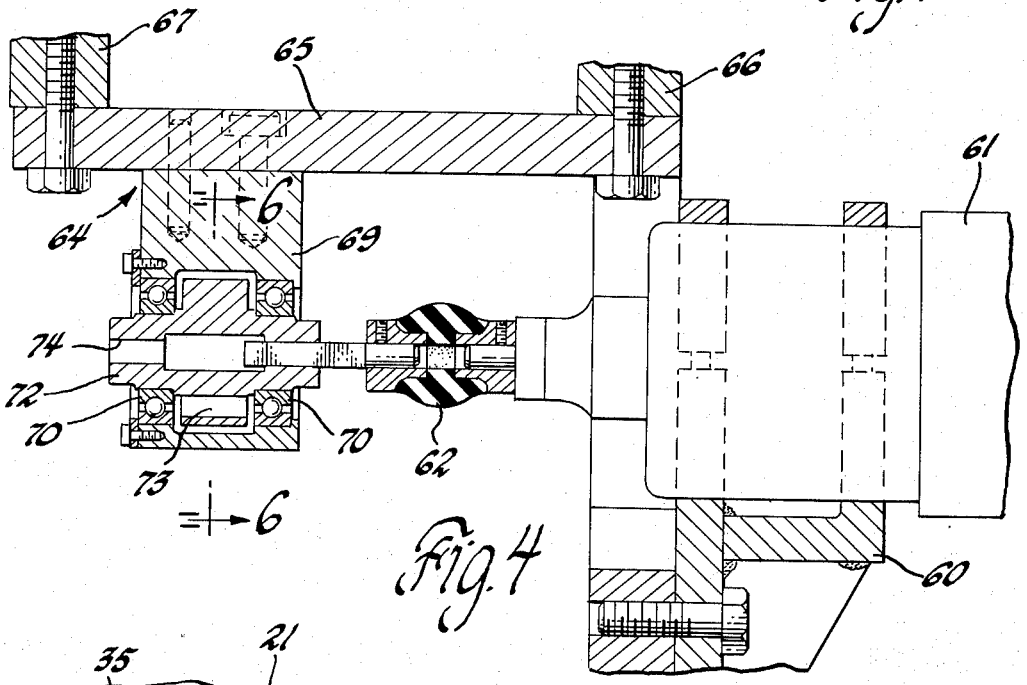
FIG. 4 is a cross-sectional view from the plane indicated by the line 4—4 of FIG. 2 and illustrating the construction and application of the eccentric shaker mechanism and its drive to the engine vibration stand.
Figure 6:
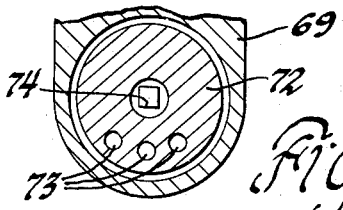
FIG. 6 is a cross-sectional view from the plane indicated by the line 6—6 of FIG. 4 and illustrating the structure of the mechanical shaker weight.

On the rear of the frame 11 there is mounted a shaking motor support 60 which supports a second electric drive motor 61. This motor connects through a flexible coupling and shaft assembly 62 with an eccentric shaker assembly 64, secured at one end to the bottom of an engine cylinder block and main bearing cap assembly. The shaker assembly, as shown in FIGS. 4 and 6 includes a mounting plate 65 that is bolted to the bottom of and interconnects the two adjacent main bearing caps 66, 67 at one end of an associated engine block. Fixed to the plate 65 is a bearing block housing 69 in which there is supported on bearings 70 a rotatable shaft and wheel element 72 containing several drilled holes 73 on one side so that it forms an eccentric shaker weight. The ends of the shaft and wheel element 72 are provided with drive openings 74 for connection with the coupling and shaft assembly 62.

It will be noted that the shaker assembly 64 is mounted to one side of the center of the plate 65 by a distance equal to one-half the difference in length between the eight and six cylinder blocks to be cleaned in the cleaning machine 10. In this way, the same shaker assembly may be used with both types of blocks, the dimensional length difference being accommodated by merely reversing the position of the shaker assembly when used on a six cylinder block from the position utilized with an eight cylinder block, as shown in FIG. 4.

OPERATION

The operation of the vibration cleaning machine, as illustrated in FIGS. 1–7, is as follows:

With the machine in position to receive a block, an engine cylinder block is moved from one of the roller conveyors 31 through the adjacent end plate opening and onto the rollers 30 within the support frame 15. When the proper position is reached, fluid pressure is applied to the cylinder assembly 42, moving the bottom and lower side pads 39, 40 so as to lift and support the block within the resilient pads 33, 34, 39 and 40 spaced around the support frame.

The eccentric shaker is then started, the speed of the motor 61 being varied as necessary to equal the frequency of the first torsional mode of resonance of the cylinder block. The eccentric mass of the shaker rotor is preselected to cause an amplitude of torsional vibration in the cylinder block which is sufficient to loosen and shake out large quantities of debris from the walls and crevices within the cylinder block without exceeding the limits to which the cylinder block may be strained without doing permanent damage. The reaching of the resonant condition may be indicated by mounting an accelerometer at a predetermined position on the end of the block, displaced from the longitudinal dynamic axis, and reading the output of the accelerometer on an indicating meter in known fashion.

While the shaker motor is operating, the drive motor 53 is also operated, causing the support frame to rotate in the rollers 14. In this way, the engine block is rotated on its longitudinal axis so that debris loosened from the various internal cavities and walls may fall out through the various openings in the engine block.

Upon completion of the cleaning cycle, which may constitute several revolutions of the engine cylinder block over a period of several minutes, the installation process is reversed and the cylinder block is removed from the machine for transport to another location for a final washing process.

Figure 7:
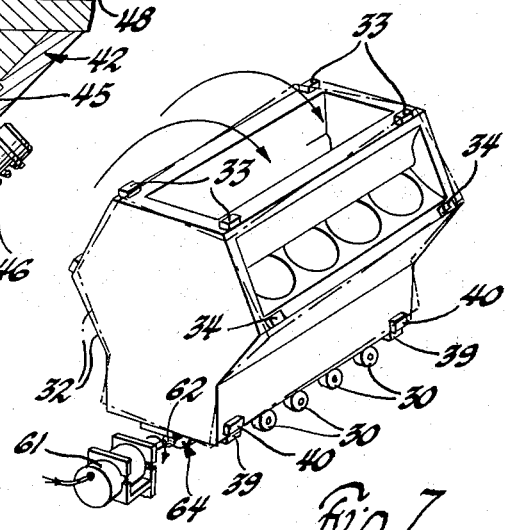
FIG. 7 is a pictorial view illustrating the application of my vibration cleaning method to an engine cylinder block.

FIG. 7 illustrates diagrammatically the operational process involved in performance of the inventive cleaning method heretofore described. As shown, the engine block is supported so that it is free to torsionally vibrate around a longitudinal axis. This may be accomplished by mounting in resilient pads 33, 34, 39, 40 as shown or by mounting in any other suitable manner that may accomplish the same purpose.

The shaker device is located preferably near an antinode (high displacement position) for the mode of vibration in which the block is to be resonated. In the case of the first torsional vibration mode, such positions are at the ends of the block, and thus the shaker weight is placed at or near an end position. The weight must also be displaced from the longitudinal axis passing through the dynamic center of gravity around which torsional vibration will occur. Thus, the selected location at the bottom of the block is a preferable one. It would, however, be possible to locate the shaker mechanism elsewhere near the end of the block at a point displaced from the longitudinal axis and still accomplish the same purposes.

When the shaker is operated and the resonant vibration condition is reached, the block is actually being torsionally twisted around its longitudinal axis as shown by the dashed lines in the figure, the twisting effect occurring at the natural first mode torsional frequency and with an amplitude preselected to avoid damaging the block while being sufficient to do an adequate cleaning job. As previously mentioned, the process preferably also involves rotation of the block, preferably around a longitudinal axis although rotation around other axes might be used, the purpose being to permit the debris freed from the internal passages and walls to fall out of the various openings in the cylinder block as it rotates.

As used in the specification and claims, the terms first torsional mode, first torsional mode of vibration, and first order torsional mode refer to torsional vibration of a workpiece in the fundamental mode of vibration wherein the vibrating workpiece is torsionally twisted about a longitudinal axis and in a vibrational pattern having a single node (nonmoving point or plane) which usually is located intermediate the ends of the workpiece. The terms resonance, resonant vibration, etc., refer to forced vibration at or near the natural vibrational frequency of the vibrating system or workpiece.

While the invention has been described by reference to a specific preferred embodiment and mode of operation, it should be understood that numerous changes could be made within the scope of the inventive concepts disclosed. Accordingly, the invention is intended to be given the full scope permitted by the language of the following claims.

What is claimed is:

1. A method for cleaning debris from a workpiece, such as an engine block, said method comprising supporting a workpiece to be cleaned in a manner permitting limited torsional movement of such workpiece about a longitudinal axis through its center of gravity, applying an unbalanced shaking force to said workpiece at a point distant from said longitudinal axis, said force being applied at a frequency and magnitude sufficient to cause said workpiece to resonante in a torsional mode with an amplitude sufficient to loosen debris from the surfaces of said workpiece but below a level which will damage said workpiece, and rotating said workpiece about an axis while in said resonating condition to permit loosened debris to fall from said workpiece surfaces.

2. A method for cleaning manufacturing debris from a workpiece having walls and cavities, such as an engine block, said method comprising resiliently supporting a workpiece to be cleaned so as to prevent substantial translational movement of said workpiece while permitting limited torsional movement of the workpiece about a longitudinal axis through its dynamic center of gravity, applying an unbalanced shaking force to said workpiece at a point near one end and distant from said longitudinal axis, said shaking force being applied at a frequency and with a magnitude that will cause said workpiece to vibrate in its first torsional mode of resonance with an amplitude sufficient to loosen debris from the walls and cavities of said workpiece but below a magnitude that will damage said workpiece, and rotating said workpiece about a longitudinal axis while in said resonating condition to permit debris to fall from said workpiece walls and cavities.

3. A workpiece cleaning stand comprising a rotatable frame adapted to receive and retain a workpiece for rotation about a longitudinal axis, resilient supports in said frame and adapted to retain such workpiece in said frame with freedom for limited torsional movements about a longitudinal axis of said workpiece, some of said supports being retractable so as to release such workpiece for installation in or removal from said frame, mechanical shaker means mountable on such workpiece adjacent one end and distant from such longitudinal axis, means for driving said shaker means at a speed capable of torsionally vibrating such workpiece in a first order torsional mode to loosen debris therein, and means for rotating said frame during operation of said mechanical shaker means to permit loosened debris to fall from said workpiece.

* * * * *